US007407123B2

(12) United States Patent
Antensteiner

(10) Patent No.: US 7,407,123 B2
(45) **Date of Patent: *Aug. 5, 2008**

(54) REFINER PLATES WITH LOGARITHMIC SPIRAL BARS

(75) Inventor: Peter Antensteiner, Lewisburg, PA (US)

(73) Assignee: Durametal Corporation, Tualatin, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/476,779

(22) PCT Filed: Apr. 22, 2003

(86) PCT No.: PCT/US03/12417

§ 371 (c)(1),
(2), (4) Date: Nov. 5, 2003

(87) PCT Pub. No.: WO03/090931

PCT Pub. Date: Nov. 6, 2003

(65) Prior Publication Data

US 2004/0149844 A1 Aug. 5, 2004

Related U.S. Application Data

(60) Provisional application No. 60/375,531, filed on Apr. 25, 2002.

(51) Int. Cl.
*B02C 7/04* (2006.01)
*B02C 7/06* (2006.01)
*B02C 13/20* (2006.01)

(52) U.S. Cl. ..... 241/261.2; 241/296; 241/298

(58) Field of Classification Search ..... 241/261.2, 241/261.3, 296, 297, 298
See application file for complete search history.

(56) References Cited

U.S. PATENT DOCUMENTS

| | | | | |
|---|---|---|---|---|
| 3,589,630 | A * | 6/1971 | Danforth et al. | 241/261.1 |
| 3,674,217 | A | 7/1972 | Reinhall | |
| 4,023,737 | A * | 5/1977 | Leider et al. | 241/261.3 |
| 4,874,136 | A * | 10/1989 | Webster | 241/251 |
| 5,425,508 | A * | 6/1995 | Chaney | 241/261.2 |
| 5,893,525 | A * | 4/1999 | Gingras | 241/298 |
| 6,042,036 | A * | 3/2000 | Virving et al. | 241/261.3 |
| 6,276,622 | B1 * | 8/2001 | Obitz | 241/261.3 |
| 6,418,927 | B1 * | 7/2002 | Kullik | 128/204.18 |
| 2002/0050066 | A1 * | 5/2002 | Krauss | 30/376 |

* cited by examiner

*Primary Examiner*—Bena Miller
(74) *Attorney, Agent, or Firm*—Alix, Yale & Ristas, LLP

(57) ABSTRACT

A special shape of bars on refining discs or plate segments (54) of a rotating disc refiner (10) is disclosed including a plurality of bars (76) generally extending outwards toward the outer end of the disk across its surface, arranged in a single, two or more radial zones (64, 66, 68), the plurality of the bars within a zone being curved with the shape of a logarithmic spiral. Disc refiners including such refining discs are also disclosed.

14 Claims, 13 Drawing Sheets

REFINER PLATES WITH LOGARITHMIC SPIRAL BARS

RELATED APPLICATION

This is the U.S. national stage filing of International Application No. PCT/US03/12417 filed Apr. 22, 2003, which claims priority under 35 U.S.C. 119(e) from U.S. App. No. 60/375,531 filed Apr. 25, 2002.

BACKGROUND OF THE INVENTION

The present invention relates to refining discs and plate segments for refining discs, and more particularly to the shape of the bars that define the refining elements of the discs or segments.

Disc refiners for lignocellulosic material, ranging from saw dust to wood chips, are fitted with refining discs or segments. The material to be refined is treated in a gap defined between two refining discs rotating relative to each other. The material moves in the grooves formed by the bars located on the disc surfaces, both in a generally radial plane, providing a transport function, and out of plane, providing a mechanism for material stapling on the leading edges of the crossing bars. The instantaneous overlap between the bars located on each of the two disc faces forms the instantaneous crossing angle. The crossing angle has a vital influence on the material stapling or covering capability of the leading edges.

Conventional bar geometries, particularly parallel straight line, radial straight line, and curved in the form of inviolate arcs on circular evolutes, show a change of bar crossing angle with respect to radial position within refining zones. Parallel straight-line patterns show furthermore a change of bar angle with respect to peripheral position within a field of parallel bars.

Since bar crossing angle is a determining factor for covering probability, a variation in bar angle leads to a variation in covering probability as well. Therefore an inhomogeneous distribution of material in the gap as a function of radial and angular position is unavoidable by conventional bar designs. Representative patents directed to particular configurations of bars and grooves on segments for refiner plates, include: U.S. Pat. No. 6,276,622 (Obitz), "Refining Disc For Disc Refiners", Aug. 21, 2001; U.S. Pat. No. 4,023,737 (Leider et al.), "Spiral Groove Pattern Refiner Plates", May 17, 1977; and U.S. Pat. No. 3,674,217 (Reinhall), "Pulp Fiberizing Grinding Plate", Jul. 4, 1972.

SUMMARY OF THE INVENTION

In order to provide a uniform covering along the length of the bars independent of radial or angular position the bars should be shaped in a form that provides constant bar crossing angle regardless of position.

Accordingly, the object of the present invention is to provide a refining element bar shape with the desired feature of constant bar and thus constant crossing angle to promote a more homogeneous refining action.

A refiner disc or refiner plate segment wherein the bars assume the shape of a logarithmic spiral satisfies the foregoing object of the invention.

The invention may thus be characterized as a refining disc having a working surface, a radially inner edge and a radially outer edge, the working surface including a plurality of bars laterally spaced by intervening grooves and extending generally outwardly toward the outer edge across the surface, wherein the bars are curved With the shape of a logarithmic spiral.

From another aspect, the invention can be characterized as a disc refiner including first and second opposed, relatively rotatable refining discs which define a refining space or gap, the first and second discs each having a plate with a radially inner edge, a radially outer edge, and a working surface including a plurality of bars generally extending outwardly toward the outer edge across the surface, wherein the plurality of bars on at least the first disc are curved with the shape of a logarithmic spiral during operation of the refiner. Each of the bars on the first disc will be crossed in the refining space by a plurality of bars on the second disc, thereby forming instantaneous crossing angles. For each of the bars on the first disc, the crossing angle is a substantially constant nominal angle. Preferably for each of the plurality of bars on the first disc, all instantaneous crossing angles are within +/−10 degrees of the nominal crossing angle.

An additional feature of the logarithmic spiral is the variability of groove width, i.e., the distance between adjacent bars with respect to radial position. This makes the grooves open up in the direction of stock flow, which prevents plugging of the grooves with fibers and tramp material.

The invention may be described mathematically. Using polar coordinates r and $\phi$, the following transformation function to Cartesian coordinates would apply:

$$x=r\cdot\cos\phi$$

$$y=r\cdot\sin\phi$$

$$r^2=x^2+y^2$$

The general shape of the logarithmic spiral bar is represented by $$r=a\cdot e^{k\cdot\phi}$$

$$k=\cot\alpha$$

$$k=0\rightarrow\text{circle}$$

where "a" is a scale parameter for r and $\alpha$ (alpha) is the intersecting angle between any tangent to the curve and a line through the center (generatrix) of the coordinate system.

In the case of alpha=90 deg or −90 deg, the tangent of the curve in any point would be orthogonal to the generatrix, and the curve is therefore a circle with radius a.

This unique bar shape provides not only identity for individual bar angles but also the so-called cutting or crossing angle assumes the same identity throughout the whole refining zone.

The invention includes a method for manufacturing a set of opposed plates including the steps of forming a pattern of bars and grooves that substantially conform to the foregoing mathematical expressions.

BRIEF DESCRIPTION OF THE DRAWINGS

The preferred embodiment of the invention will be described with respect to the accompanying drawings, in which.

DESCRIPTION OF THE PREFERRED EMBODIMENT

Figure 1:
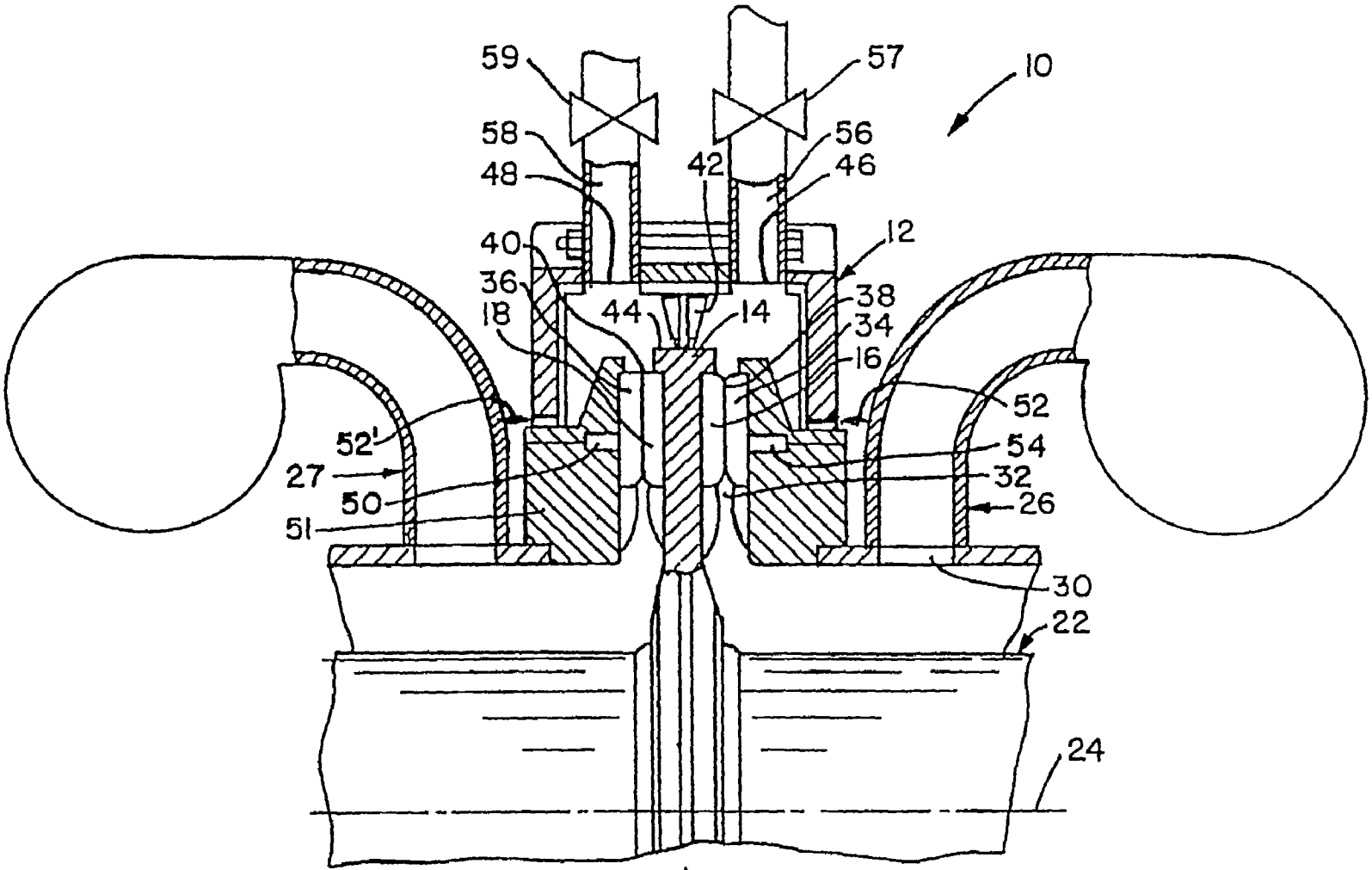
FIG. 1 is a schematic of an internal portion of wood chip refiner, illustrating the relationship of opposed, relatively rotating discs, each of which carries an annular plate consisting of a plurality of plate segments.

FIG. 1 is a schematic showing a refiner 10 with casing 12 in which opposed discs are supported, each of which carries an annular plate or circle consisting of a plurality of plate segments. The casing 12 has a substantially flat rotor 14 situated therein, the rotor carrying a first annular plate defining a first grinding face 16 and a second annular plate defining a second grinding face 18. The rotor 14 is substantially parallel to and symmetric on either side of, a vertical plane indicated at 20. A shaft 22 extends horizontally about a rotation axis 24 and is driven at one or both ends (not shown) in a conventional manner.

A feed conduit 26 delivers a pumped slurry of lignocellulosic feed material through inlet opening 30 on either side of the casing 12. At the rotor, the material is re-directed radially outward through the coarse breaker region 32 whereupon it moves along the first grinding face 16 and a third grinding face 34 juxtaposed to the first face so as to define a right side refining zone 38 therebetween. Similarly, on the left side of the rotor 14, material passes through the left refining zone 40 formed between the second grinding face 18 and the juxtaposed grinding face 36.

A divider member 42 extends from the casing 12 to the periphery, i.e., circumference 44, of rotor 14, thereby maintaining separation between the refined fibers emerging from the refining zone 38, relative to the refined fibers emerging from the refining zone 40. The fibers from the right refining zone are discharged from the casing through the discharge opening 46, along discharge stream or line 56, whereas the fibers from the left refining zone 40 are discharged from the casing through opening 48 along discharge line 58.

Thus material to be refined is introduced near the center of a disc, such that the material is induced to flow radially outwardly in the space between the opposed refining plates, where the material is influenced by the succession of groove and bar structures, at a "beat frequency", which is dependent on the dimensions of the grooves and the bars, as well as the relative speed of disc rotation. The material tends to moves radially outward, but the shape of the bars and grooves is intentionally designed to produce a stapling effect and a retarding effect whereby the material is retained in the refining zone between the plates for an optimized retention time.

Although the gap between plates where refining action occurs is commonly referred to as the "refining zone", the opposed plates often have two or more distinct bar and groove patterns that differ at radially inner, middle, and outer regions of the plate; these are often referred to as inner, middle, and outer "zones" as well.

In accordance with the present invention, the further variable of the bar-crossing angle is maintained substantially constant. This is accomplished by the bars substantially conforming in curvature to the mathematical expressions set forth in the Summary. In particular, during operation of the refiner each of the bars on the first disc will be crossed in the refining space by a plurality of bars on the second disc, thereby forming instantaneous crossing angles, and for each of the bars on the first disc, the crossing angle is a substantially constant nominal angle. To the extent the invention is not perfectly implemented, a significant benefit relative to the state of the art can still be achieved when the instantaneous crossing angles in a given refining zone are within +/−10 degrees of the nominal crossing angle.

Figure 2:
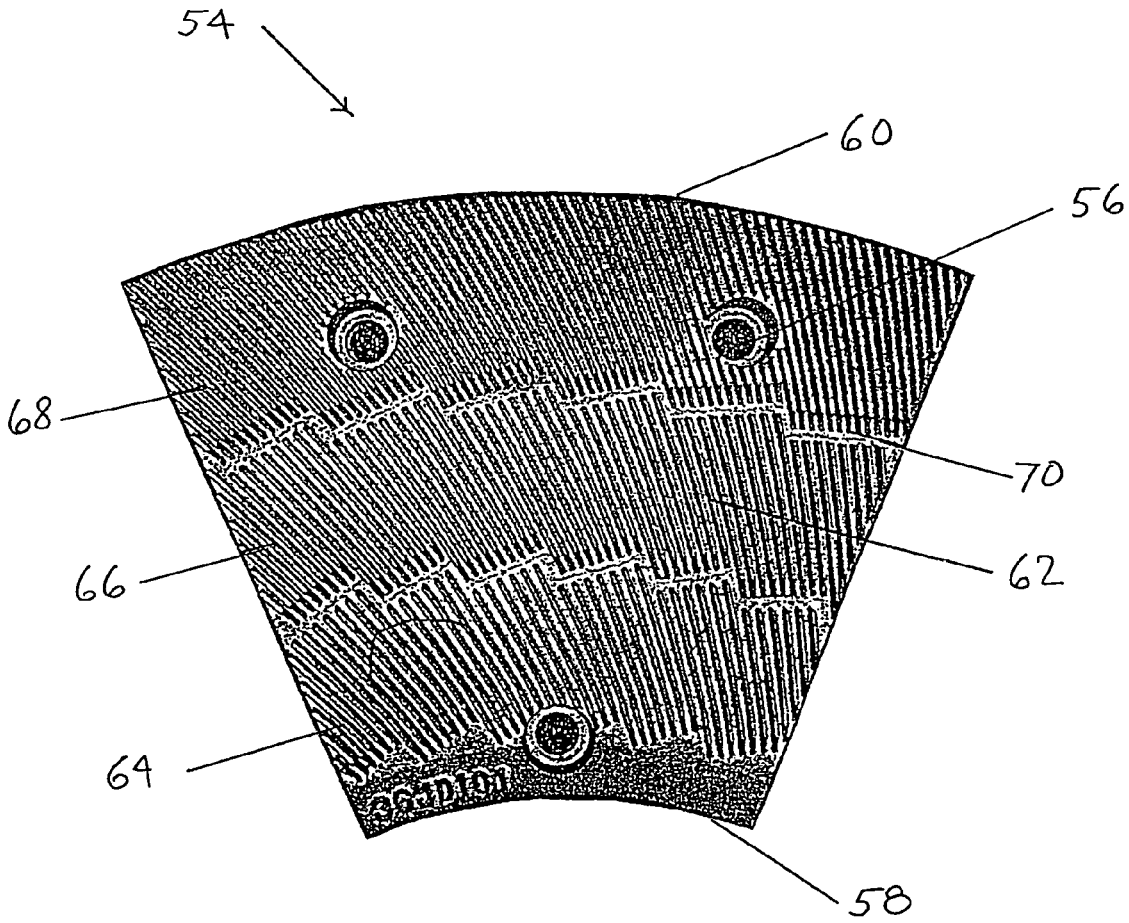
FIG. 2 is a photograph of a refiner plate segment incorporating refiner bars in the shape of logarithmic spirals according to the invention.

With reference to FIG. 2, there is shown a refining segment 54, which is disposed on the inside of a refining disc and which is intended for coaction with the same or different kind of refining segments on an adjacent refining disc on the other side of the refining gap. Several segments as shown in FIG. 2 are typically secured side by side to a base (e.g., rotor or stator) to form a substantially circular (e.g., circular or annular) refining plate. The segment has the general shape of a truncated sector of a circle. Each segment may be mounted to the plate holder surface of the base by means of machine screws inserted through countered bolt holes 56. Some refiner designs may allow fastening the plates from the back, which eliminates the boltholes from the face of the plate. In general segments are mounted on discs rotating relative to each other, which could be achieved by the presence of one rotor and one stator (single disc refiner), or by one rotor segmented on both sides and operating against two stators (double disc refiner), or by several rotors working against each other and a pair of stators (multi disc refiner), or by counter-rotating discs.

Each refining disc segment can be considered as having a radially inner end 58, a radially outer end 60, and a working surface therebetween, the working surface including a plurality of bars 62 laterally spaced by intervening grooves and extending generally outwardly toward the outer end across the surface. Preferably all, but at least most, of the bars are curved with the shape of a logarithmic spiral.

As is common for both low and high consistency refining of wood chip or second stage material, the bars on a plate formed by the segments of FIG. 2 are arranged in three radially distinct refining zones 64, 66, 68, between the inner and outer plate edges 58, 60. A Z-shaped transition zone 70 accomplishes the material flow transition between the individual refining zones. In this embodiment, the bars in each zone follow a logarithmic spiral. The particular shape parameter (alpha) may be different for each zone, but the shape parameter for each confronting zone on the opposed plate, would preferably be the same.

This particular and unique shape provides the advantage of the independence of bar angle from the location of the bar on the plate in a particular refining zone. Since the particular shape of the logarithmic spiral guarantees the bar intersecting angle with lines through the center of the plate to be constant, no bar angle and therefore crossing angle variation in the course of the relative movement of rotor and stator segments occurs. Since bar angle has a significant impact on refining action and bar covering probability, any variation of bar and crossing angle will result in a variation of refining action. The invention achieves maximum homogeneity of refining action by minimizing bar angle variation.

The width of the groove between two adjacent logarithmic spiral bars is variable and increases with radial distance by the nature of the curve. Thus the groove width at the ID of zone 68 is smaller than on the OD of the zone, the OD of the outer edge 60 of the plate in this case. Therefore the open area available for stock flow increases disproportional with increasing radius. This feature provides increased resistance against plugging in comparison to parallel bar designs, where no groove width variation occurs.

Figure 3:
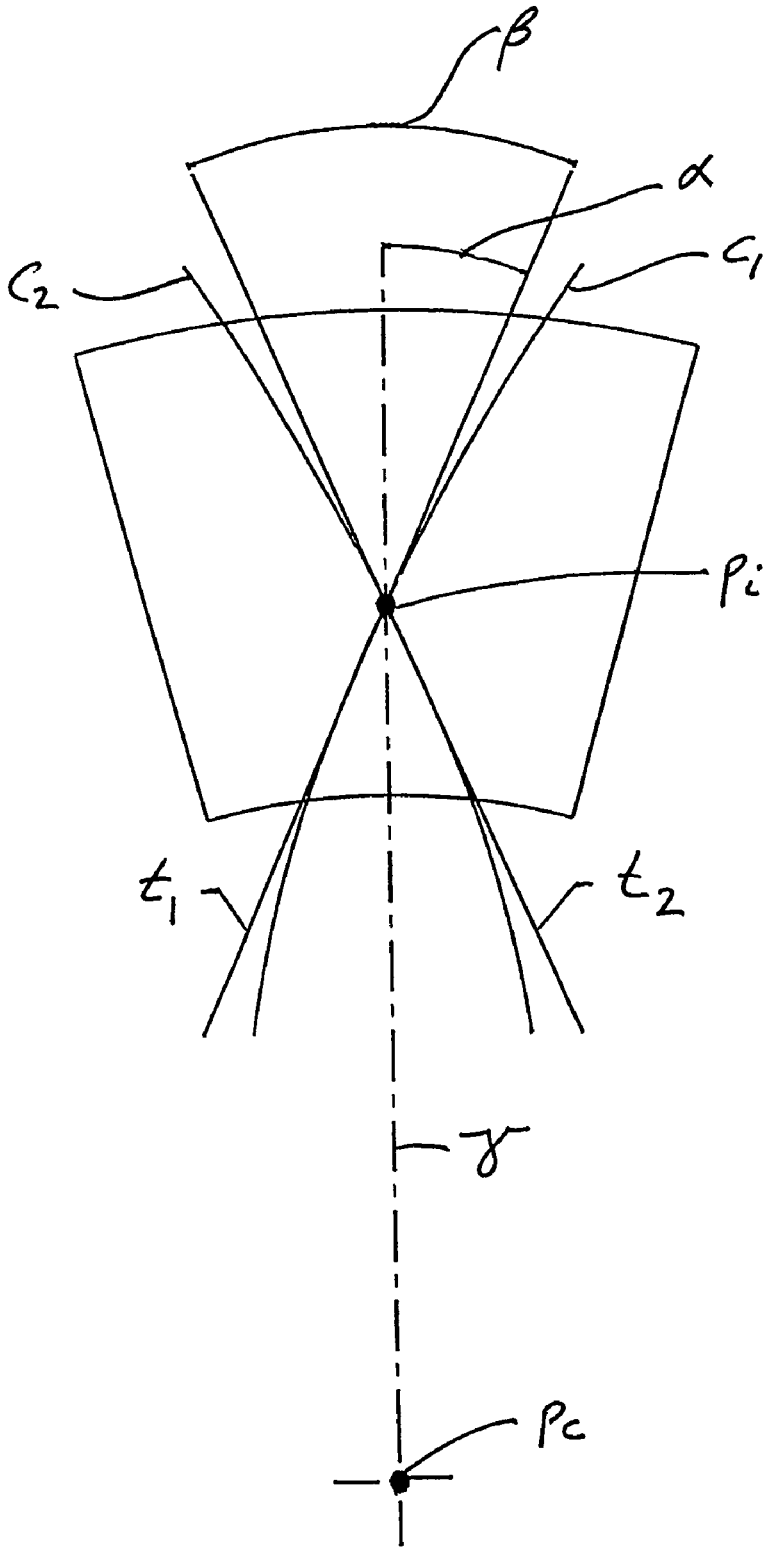
FIG. 3 is a schematic by which the mathematical representation of the invention can more easily be understood.

With reference again to the mathematical expressions appearing in the summary above, and the associated FIG. 3, the crossing angle $\beta$ appears as the intersecting angle between the tangents $t_1$ and $t_2$ to the two curves $c_1$ and $c_2$ (i.e., the curved leading edges of crossing bars) at the point of intersection $p_i$. The angle $\beta$ between the tangents remains constant, at every possible crossing point. Each bar has an angle $\propto$ relative to the generatrix $\gamma$ passing through the center point $P_c$.

Figure 4:
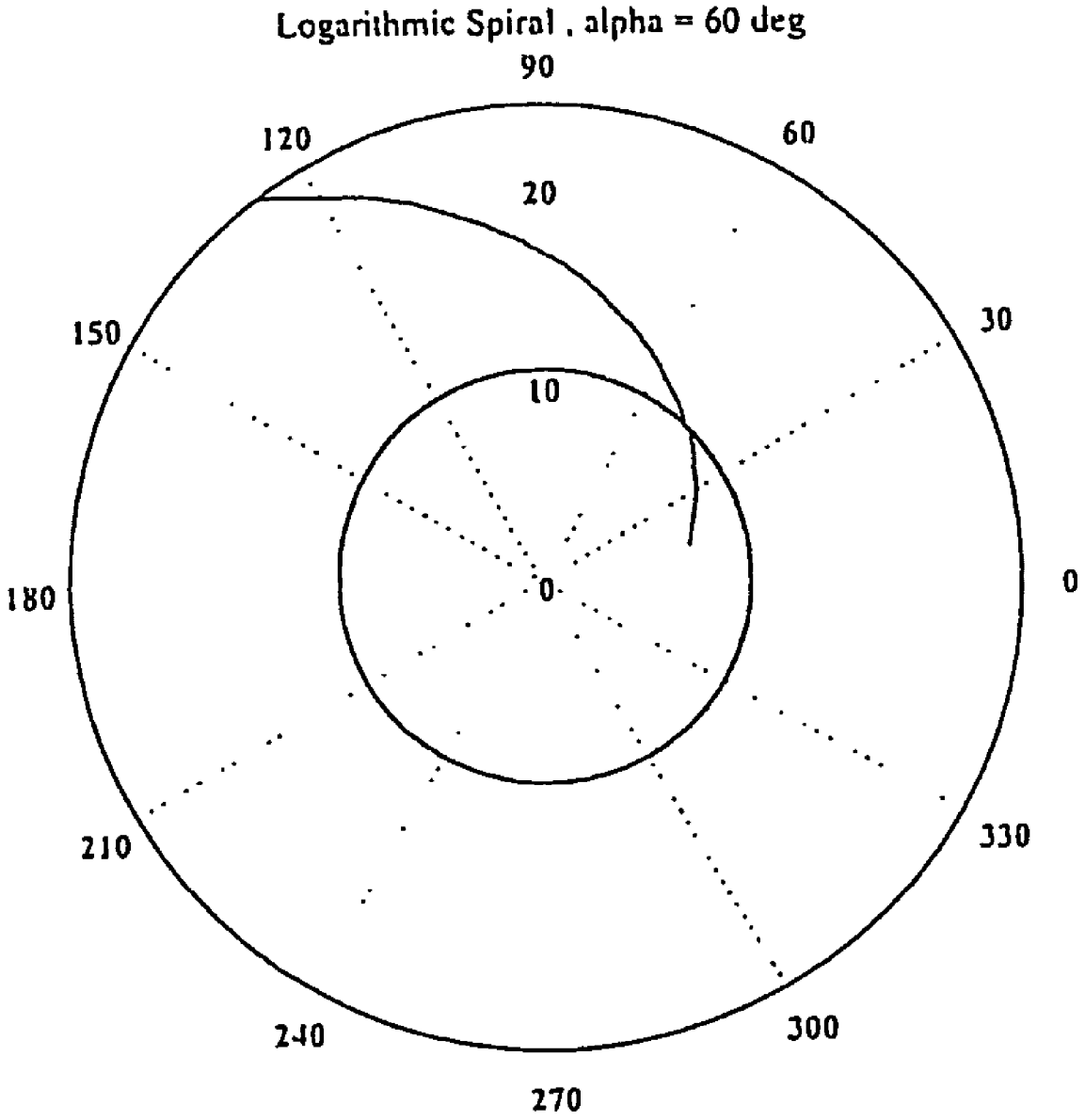
FIG. 4 is a schematic representation of the bar curvature for the value alpha=60 deg.
Figure 5:
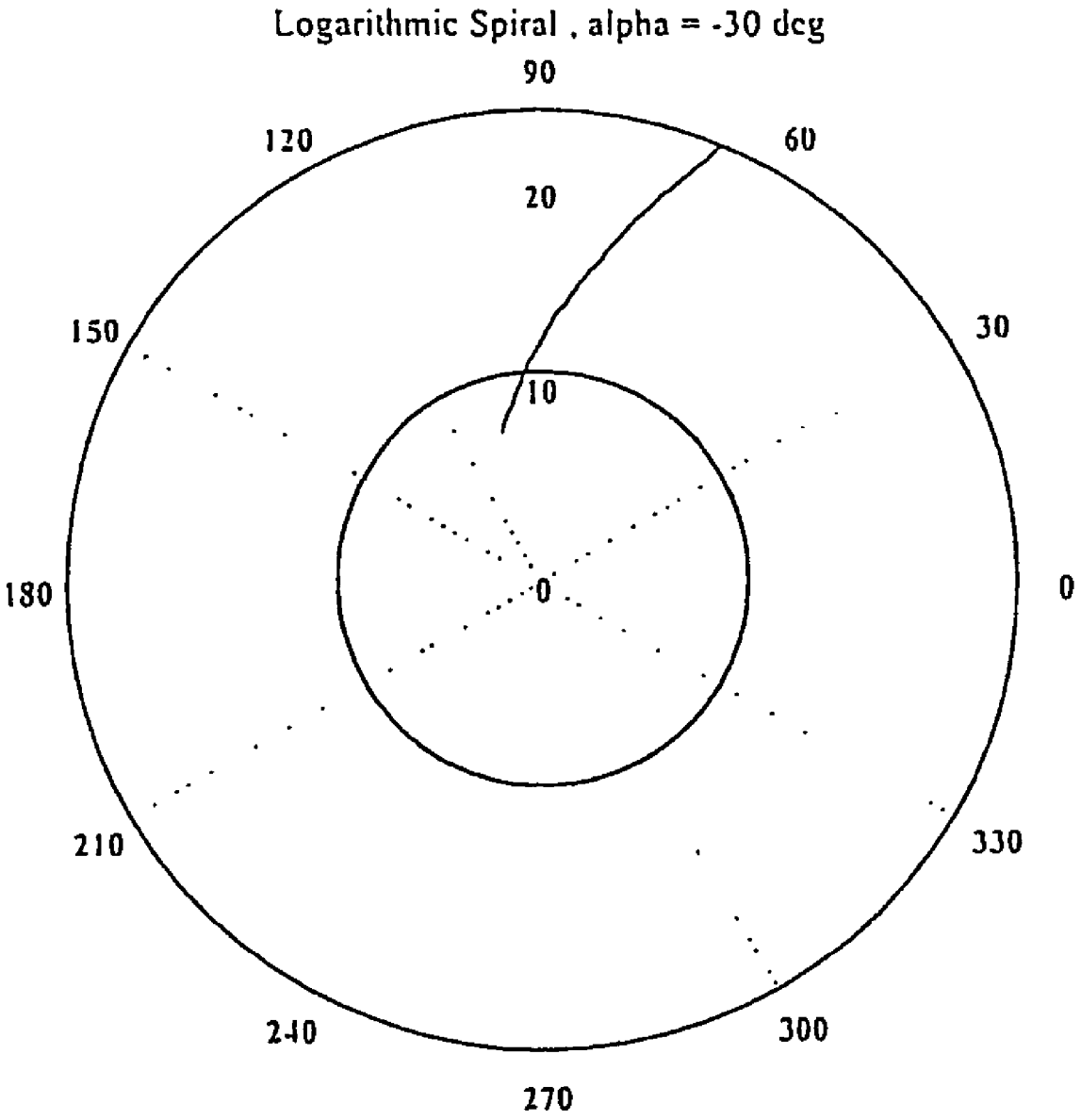
FIG. 5 is a schematic representation of the bar curvature for the value alpha=−30 deg.

FIGS. 4 and 5 are schematic representations of the bar curvature for two different values of alpha. FIG. 4 shows the curvature for alpha=60 degrees, and FIG. 5 shows the curvature for alpha=−30 degrees. The designer has the flexibility to select the angle between plus 90 degrees and minus 90 degrees.

The mathematical expression for the shape of the logarithmic spiral bar, defines any given bar which in the limit, is a line of infinitesimal thickness such that the location of any given point on the line is a function of the angular position (phi) of the point relative to a reference radius or diameter through the center (along the generatrix of the coordinate system) and the intersecting angle (alpha) between the tangent to the curvature of the bar at the point, and the generatrix. This mathematical relationship is used in a practical sense, to design functional bar patterns.

This would typically be performed in a computer assisted design (CAD) system which is readily programmed to incorporate the mathematical model and which has an output that can translate the mathematical modeling of the segment, to equipment for producing a tangible counterpart from a segment blank. This would proceed by having one spiral curve calculated in radial increments, thereby establishing the "mother" of all the other bars, by determining the starting radius as well as the starting angle (arrived at by adding a constant to the calculation result). The one full curve (representing the leading edge of the "mother" bar) will be located somewhere on the segment. In a CAD system, the curve will not necessarily be a mathematically continuous, full logarithmic spiral but rather can be approximated by a spline fit. The accuracy of the spline depends on the radial increments selected. Moreover, the first few points on the spline, close to the inside diameter of the segment, may not match closely to the theoretically logarithmic spiral, but this artifact of the CAD system has little adverse consequence if limited to the small radius at the inside diameter. The typical CAD system (e.g., AutoCad®) then allows the user to offset the trailing edge of the mother bar, thereby giving the bar a selected width which is established from the inner to the outer radius of the segment. The mother bar can then be copied and rotated to fill the segment. For example, the user can specify the bar width at a given radius, the number of bars for the segment, or the minimum desired groove width at a given radius, etc.

It should be appreciated that, in view of modern manufacturing techniques, the term "logarithmic spiral" as used herein, although based on a mathematical expression, may in practice only approximate the mathematical expression through a series of straight or curved lines each of which is relatively short as compared with the full length of the curve from the inner to the outer radius of the segment, or from the inner radius to the outer radius of a given zone in the segment. Similarly, a reasonable degree of latitude should be afforded the inventor in reading the term "logarithmic spiral" on the shape of curved bars according to which one of ordinary skill in the relevant field of endeavor would recognize an attempt to maintain conservation of the bar crossing angle in the radial direction on a given segment, or within the zone of a given segment. The benefit of the present invention can be realized to a significant extent relative to the prior art, even if the logarithmic spiral is merely approximated, e.g., if the crossing angle is maintained within +/−10 degrees from the radially inner end to the radially outer end of a given bar.

Variations of the invention can be readily understood without reference to other drawings. For example, in the context of the invention as implemented in a refiner, a first refining disc faces a second relatively rotatable refining disc with a refining space there between. Either both or only one of the first and second discs has a shape and surface with an inner end and an outer end including a plurality of bars generally extending outwardly toward the outer end across the surface, with the plurality of bars being curved with the shape of a logarithmic spiral. If both discs have segments with curved bars following the same logarithmic spiral, constant bar crossing angles will be achieved. If the facing discs both have logarithmic spiral bar curvature, but with different parameters alpha, some design variability for specialty purposes can be achieved. If only one disc has a logarithmic spiral bar curvature, and the facing disc has a conventional bar pattern, the result will still advantageously reduce bar crossing angle variation relative to two facing discs having the same such conventional pattern.

Figure 6:
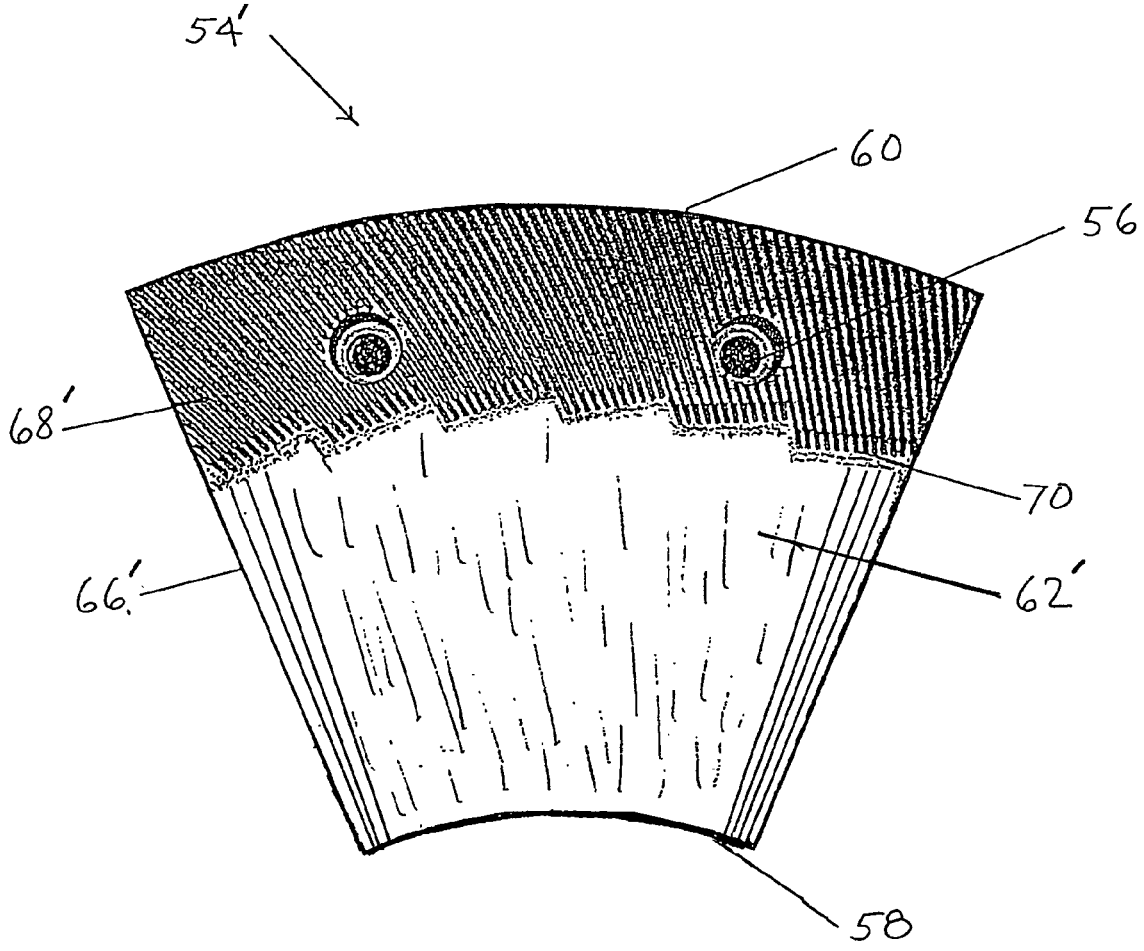
FIG. 6 is a schematic plan view similar to FIG. 2, showing an embodiment wherein only the outer of a plurality of refining zones has bars in a logarithmic spiral pattern.

In another embodiment the logarithmic spiral bar curvature is present in fewer than all the radial zones. FIG. 6 is a schematic plan view similar to FIG. 2, showing an embodiment of a segment 54' wherein only the outer 68' of a plurality of refining zones on working surface 62' has bars in a logarithmic spiral pattern. In a two or three zone plate, the radially outermost zone would preferentially have the logarithmic spiral bars, because the number of fiber treatments increases with disc radius according the third power of the radius. In such case, the inner zone(s) 66' would preferably follow the so-called "constant angle" pattern, as exemplified in the 079/080 pattern available from Durametal Corp. for the Andritz Twin-Flo refiner and shown only schematically in FIG. 6.

Figure 7A:
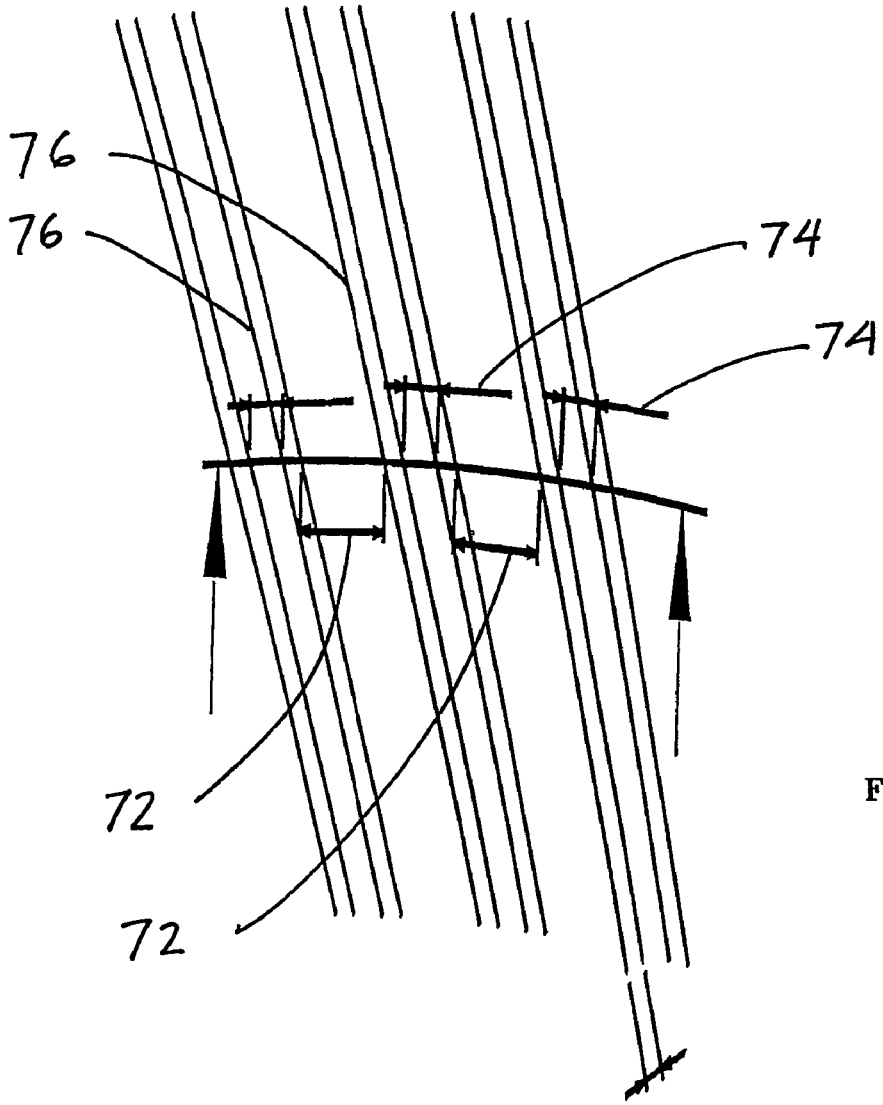
FIGS. 7 A and B are plan and section views of a portion of a plate segment, showing a variation having alternating larger and smaller spacing between bars at the identical radius from the center.
Figure 7B:
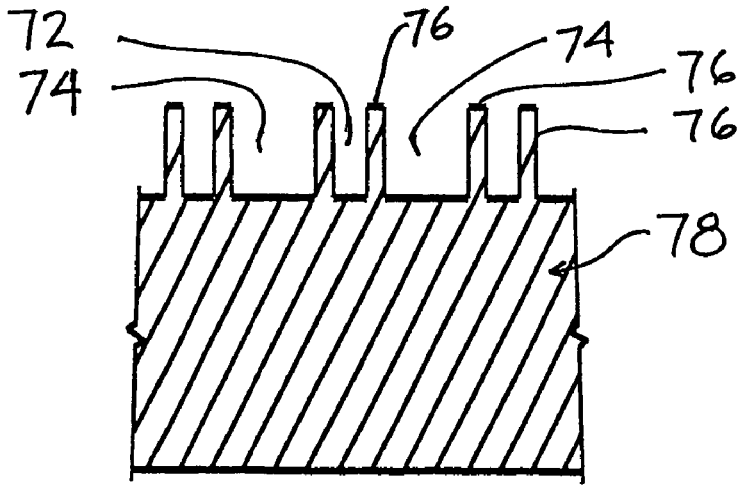

Other implementations of the logarithmic spiral concept are shown in FIGS. 7-13. FIGS. 7 A and B are plan and section views of a portion of a plate segment, showing a variation having alternating larger and smaller spacing 72, 74 between bars 76 at the identical radius from the center of a segment 78.

Figure 8A:
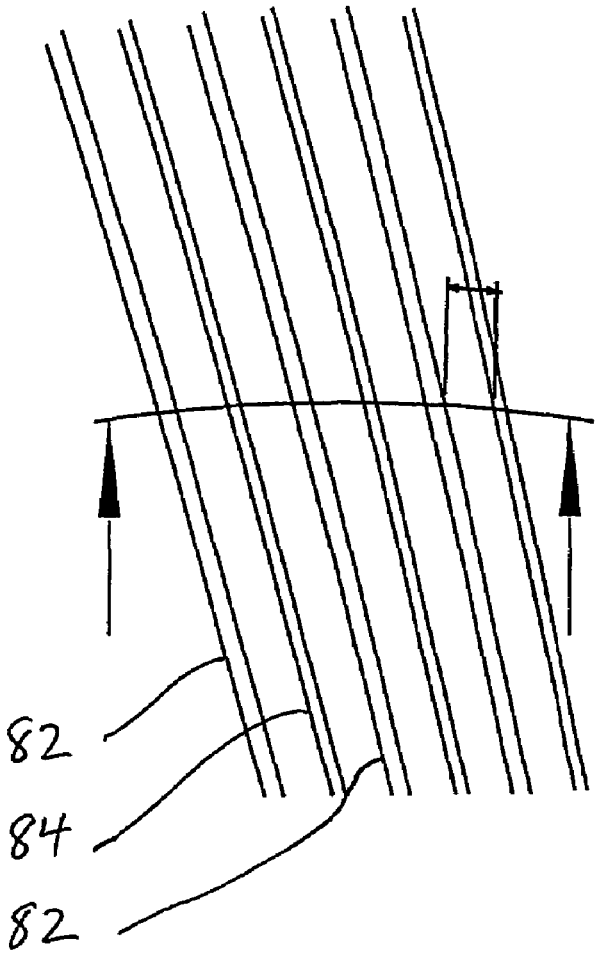
FIGS. 8 A and B are plan and section views of a portion of a plate segment, showing relatively larger and relatively smaller bar widths alternating at identical radius from the center.
Figure 8B:
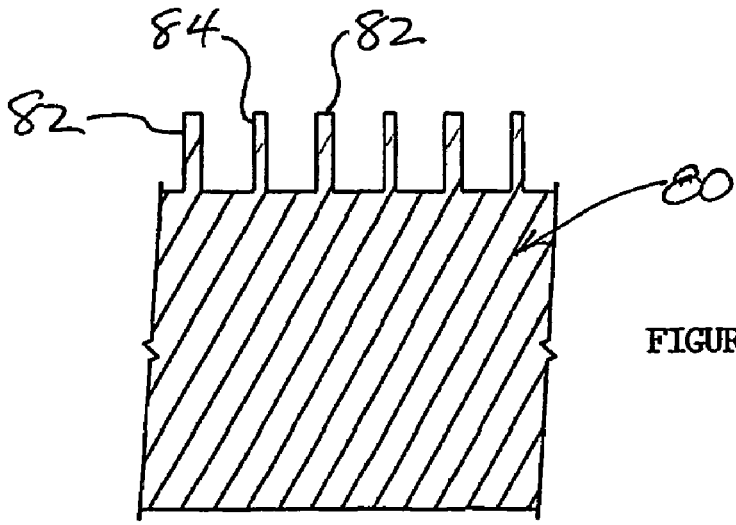

FIGS. 8 A and B are plan and section views of a portion of a plate segment 80, showing relatively larger 82 and relatively smaller 84 bar widths alternating at identical radius from the center.

Figure 9A:
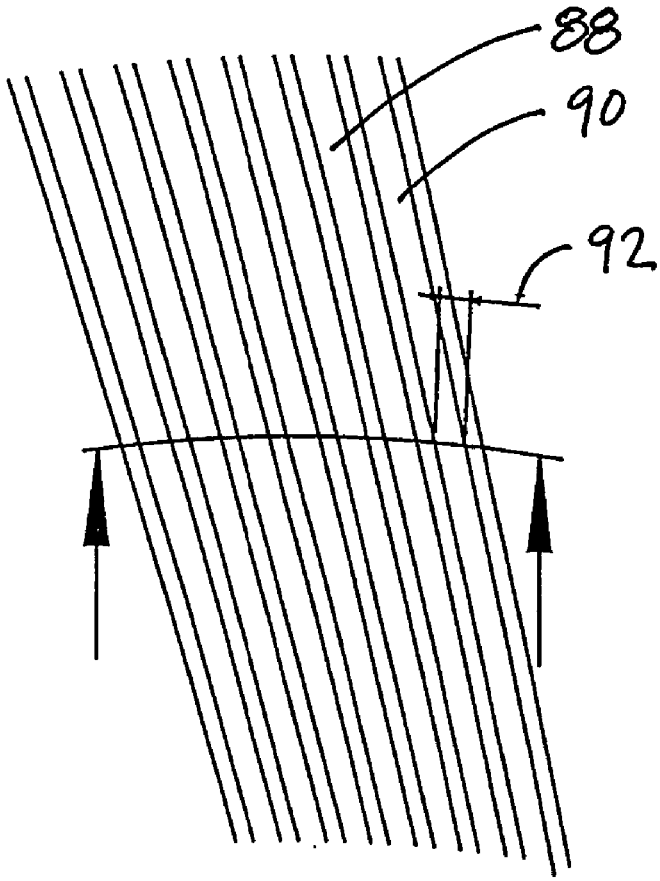
FIGS. 9 A and B are plan and section views of a portion of a plate segment, showing relatively deeper and relatively shallower groove depths alternating at identical radius from the center.
Figure 9B:
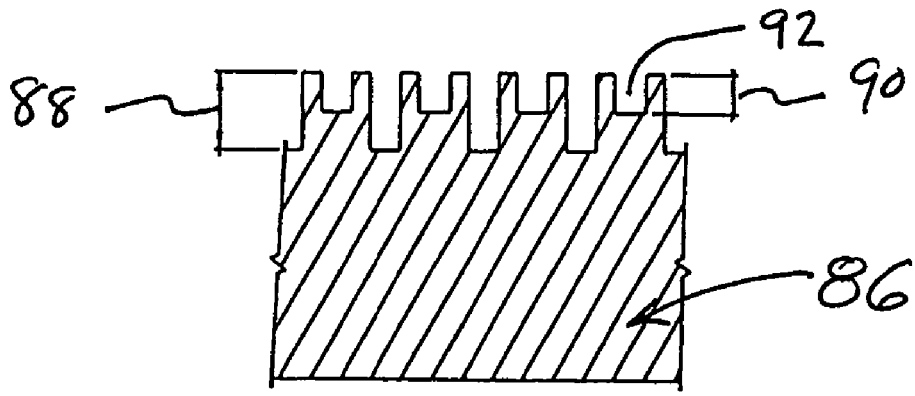

FIGS. 9 A and B are plan and section views of a portion of a plate segment 86, showing relatively deeper 88 and relatively shallower 90 groove depths of the same spacing 92 alternating at identical radius from the center.

Figure 10:
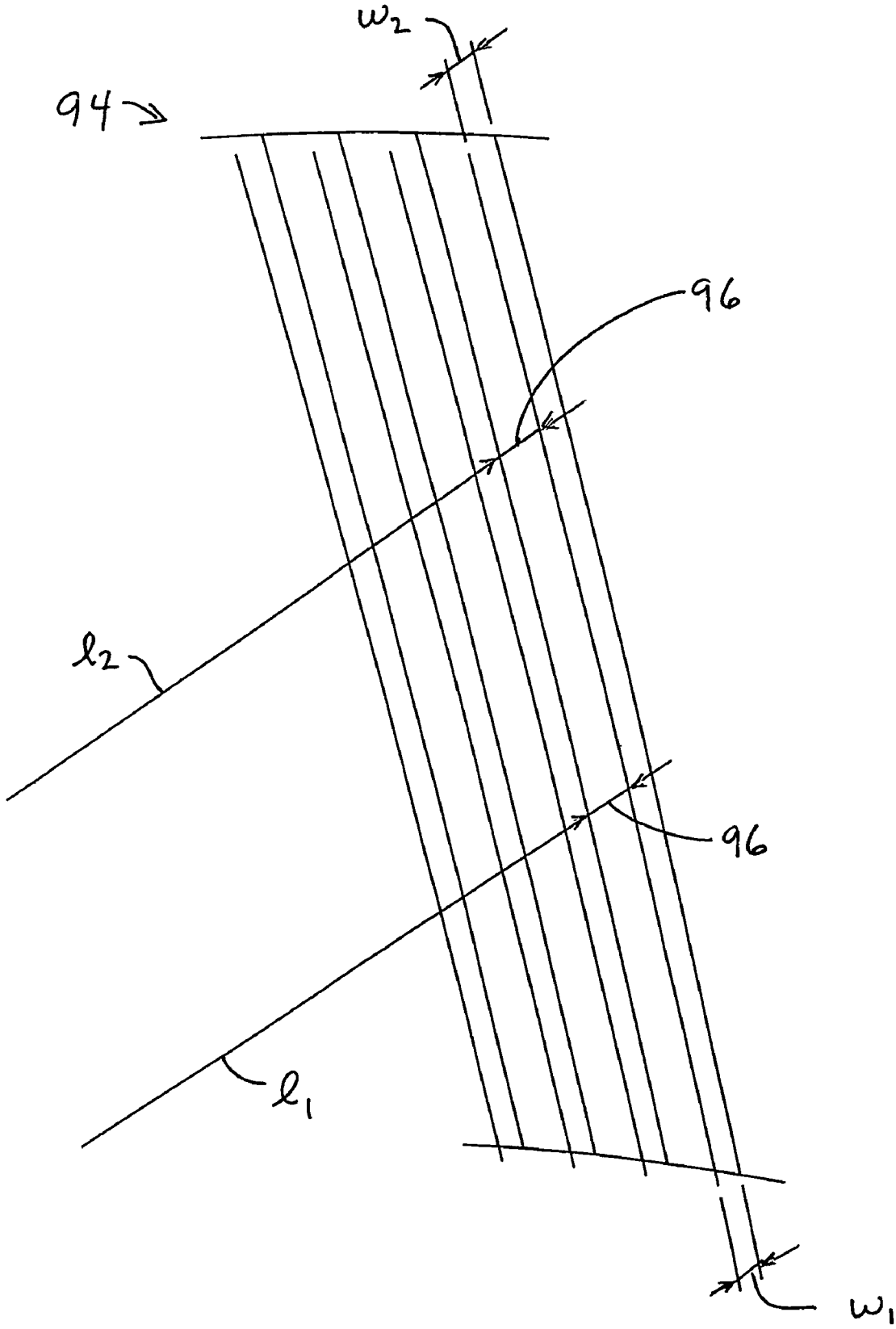
FIG. 10 is a plan view of a portion of a plate segment, wherein the bar width dimensions increase with increasing radius.

FIG. 10 is a plan view of a portion of a plate segment 94, wherein the bar width dimensions $w_1$ and $w_2$ increase with increasing radius while the grooves maintain constant spacing 96 as measured from the center point of the spiral are along lines $l_1$ and $l_2$.

Figure 11:
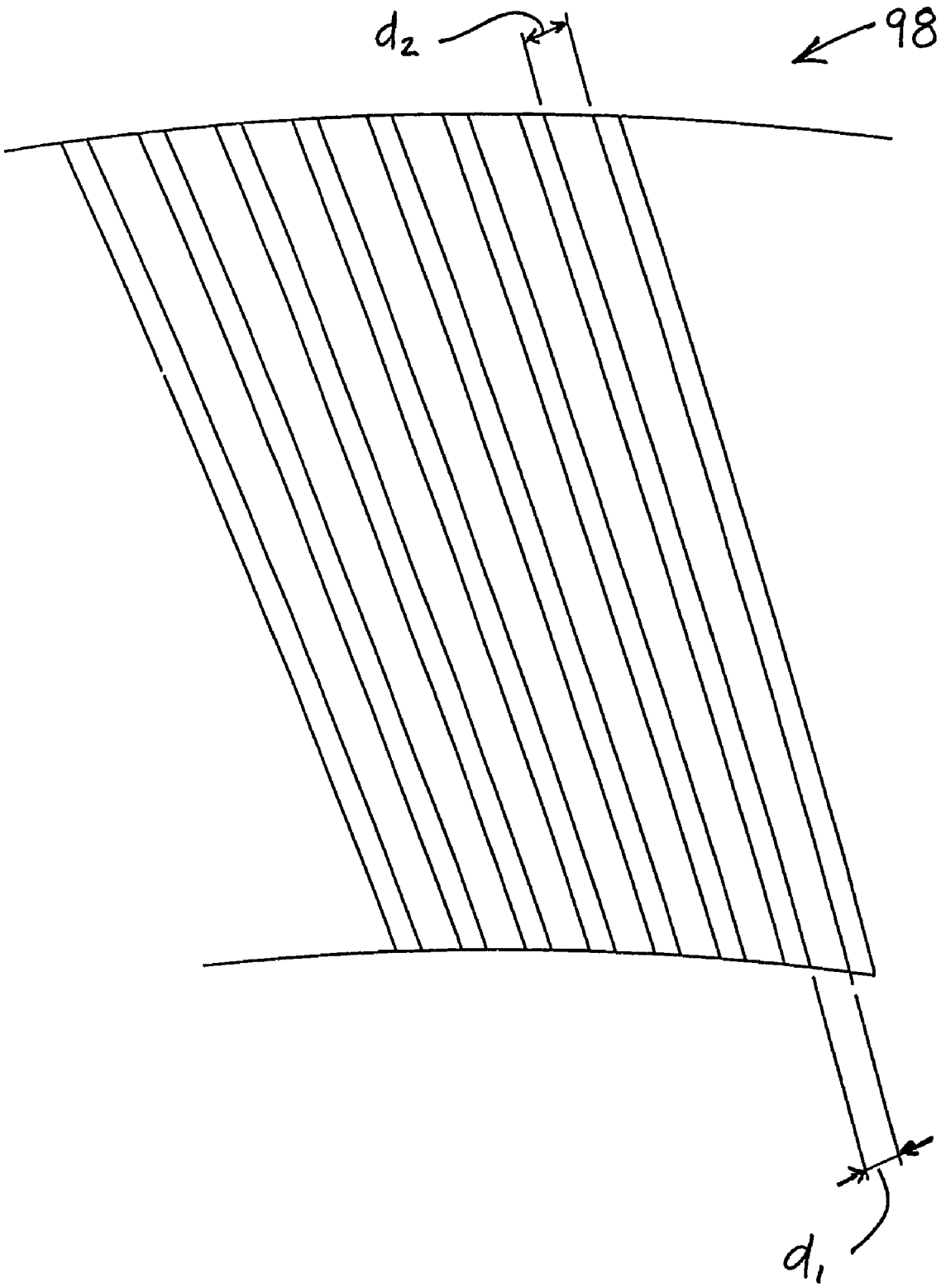
FIG. 11 is a plan view of a portion of a plate segment, wherein the groove spacing dimensions increase with increasing radius.

FIG. 11 is a plan view of a portion of a plate segment 98, wherein the groove spacing dimensions $d_1$ and $d_2$ increase with increasing radius.

Figure 12:
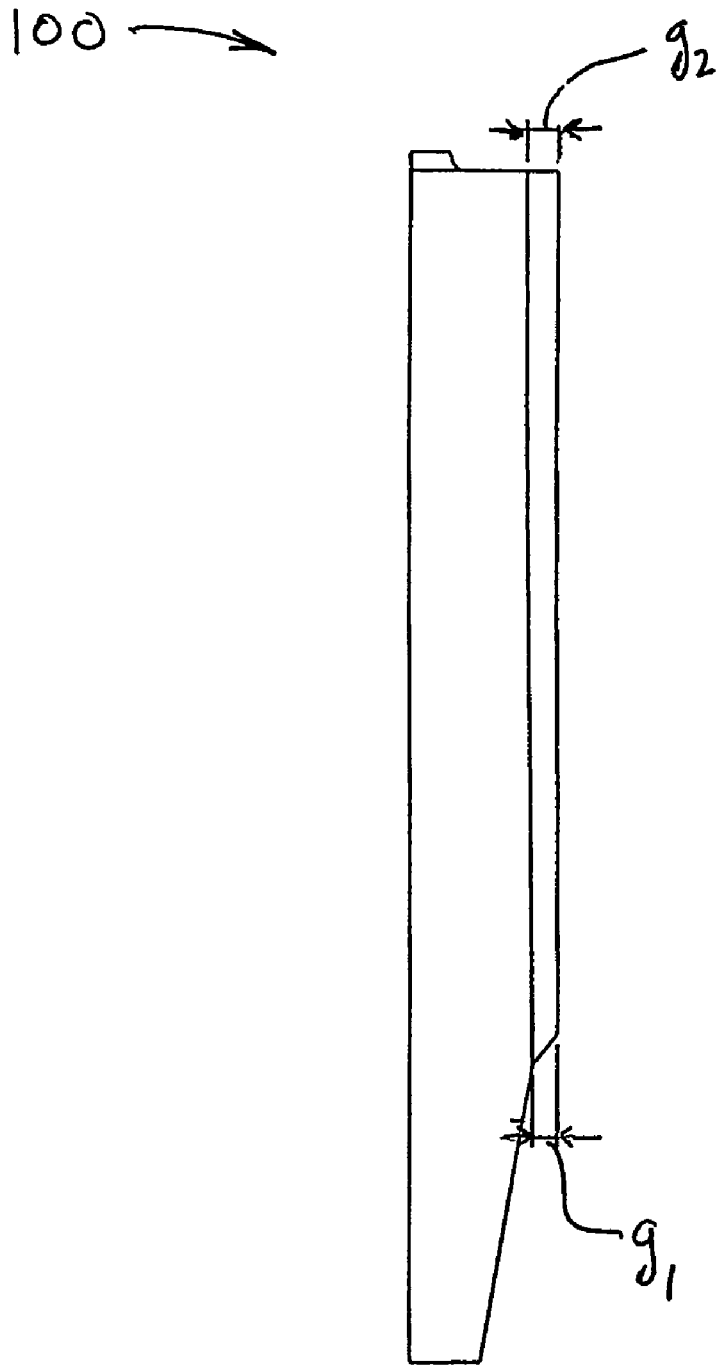
FIG. 12 is a side view of a portion of a plate segment, wherein the groove depth dimensions increase with increasing radius.

FIG. 12 is a side view of a portion of a plate segment 100, wherein the groove depth dimensions $g_1$ and $g_2$ increase with increasing radius.

Figure 13A:
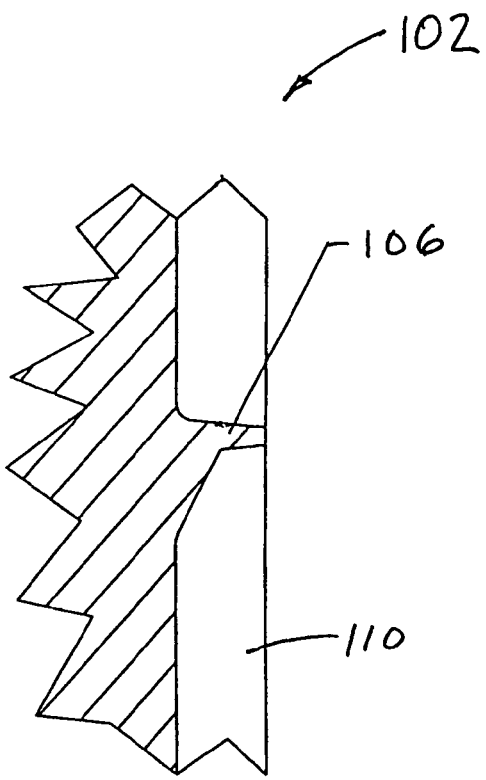
FIGS. 13 A and B are schematic views of a portion of plate segment, having surface and surface dams, respectively, between adjacent bars.
Figure 13B:
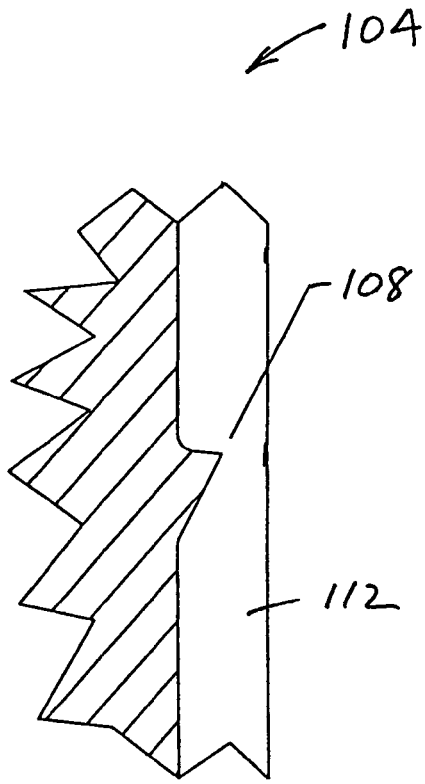

FIGS. 13 A and B are schematic views of a portion of plate segments 102 and 104, having surface 106 and subsurface dams 108, respectively, between adjacent bars 110, 112, respectively.

Although the invention herein has been described with reference to a particular, preferred embodiment, it is to be understood that these embodiments are merely illustrative of the principles and applications of the present invention. It is therefore to be understood that numerous modifications can be made to the illustrative embodiments and that other arrangements may be devised without departing from the spirit and the scope of the present invention.

What is claimed is:

1. A refining disc having a working surface, a radially inner end and a radially outer end, the working surface including a plurality of bars having inner and outer ends, laterally spaced by intervening grooves, and extending generally outwardly toward said outer end across said surface, said bars and grooves forming a pattern defining at least one radially extending substantially annular zone and wherein each of at least a majority of said plurality of bars in said zone being curved with the shape of a logarithmic spiral from the inner to the outer end of said bars, wherein said shape of said bars conforms within manufacturing tolerances to the mathematical expression in polar coordinates:

$$r=a\cdot e^{k\cdot\phi}$$

where $\underset{k=0\rightarrow circle}{k=cot\alpha}$ and

"r" is the radial position along the centerline of the bar, "a" is a scale parameter for r and $\alpha$ is the intersecting angle between any tangent to the curve and the generatrix of the coordinate system.

2. The refining disc of claim 1, wherein the majority of bars on the disc are curved with said shape of a logarithmic spiral from the inner to the outer end of each bar.

3. The refining disc of claim 1, wherein the disc has a pattern of bars and grooves arranged in at least two radially distinct zones, and essentially all the bars in the outermost zone are curved with said shape of a logarithmic spiral.

4. The refining disc of claim 1, wherein the disc is formed by a substantially circular base and a refining plate attached to the base, the plate is formed by a plurality of plate segments each of which has a working surface including a plurality of bars being curved with said shape of a logarithmic spiral.

5. The refining disc of claim 1, wherein the angle ($\alpha$) is within the range of between +90 and 90 degrees.

6. The refiner disc of claim 1, wherein each of said bars having said shape has the same uniform thickness.

7. The refiner disc of claim 6, wherein the groove between each of any two of said plurality of bars, increases in width as the distance from said inner end increases toward said outer end.

8. A plate segment for a disc of a rotary disc refiner, comprising a working surface including a plurality of bars having inner and outer ends and laterally spaced by intervening grooves, said bars and grooves forming a pattern defining at least one radially extending zone and wherein each of at least a majority of said bars in said zone being curved with the shape of a logarithmic spiral from the inner to the outer end of said bars, wherein the shape of said bars conforms within manufacturing tolerances to the mathematical expression in polar coordinates:

$$r=a\cdot e^{k\cdot\phi}$$

where $\underset{k=0\rightarrow circle}{k=cot\alpha}$ and "r" is the radial position alone the centerline of the bar, "a" is a scale parameter for r and $\alpha$ is the intersecting angle between any tangent to the curve and the generatrix of the coordinate system.

9. The plate segment of claim 8, wherein the segment has a longer, outer edge and a shorter, inner edge, the working surface has a pattern of bars and grooves arranged in a first zone situated closer to the inner edge and a second zone situated closer to the outer edge, and essentially all the bars in the second zone are curved with said shape of a logarithmic spiral.

10. The plate segment of claim 8, wherein the segment has the shape of a truncated sector of a circle and the successive groove spacings between successive bars at the same radius of the sector, alternate between relatively larger and relatively smaller spacings.

11. The plate segment of claim 8, wherein the segment has the shape of a truncated sector of a circle and the successive bar widths between successive grooves at the same radius of the sector, alternate between relatively larger and relatively smaller widths.

12. The plate segment of claim 8, wherein the segment has the shape of a truncated sector of a circle and the successive groove spacings between successive bars at the same radius of the sector, alternate between relatively deeper and relatively shallower spacings.

13. The plate segment of claim 8, wherein for a given bar and associated groove, at least one of the bar width, groove width and groove depth dimensions change with increasing radius.

14. The plate segment of claim 8, comprising at least one of sub-surface or surface dams in the grooves between adjacent bars.

* * * * *